US005217178A

United States Patent [19]

Yarr et al.

[11] Patent Number: 5,217,178

[45] Date of Patent: Jun. 8, 1993

[54] ROLL-TO-ROLL STAMP COUNTER

[75] Inventors: George Yarr, Ballston Spa; Walter B. Moore, Windham; Robert Brzescinski, Catskill; John A. Corey, Melrose, all of N.Y.

[73] Assignee: 4-Seasons Counting Systems, Inc., Cairo, N.Y.

[21] Appl. No.: 658,511

[22] Filed: Feb. 21, 1991

[51] Int. Cl.[5] ..... B65H 18/08; B65H 35/06

[52] U.S. Cl. ..... 242/67.30 R; 101/69; 226/95; 242/56 R; 242/72.1

[58] Field of Search ..... 242/67.3 R, 56 R, 72.1, 242/74, 76; 226/95, 195; 101/69

[56] References Cited

U.S. PATENT DOCUMENTS

| | | | |
|---|---|---|---|
| 2,483,144 | 9/1949 | McConnell et al. | 242/72.1 |
| 2,615,644 | 10/1952 | Enz | 242/72.1 |
| 3,586,225 | 6/1971 | Takata | 226/95 |
| 3,621,964 | 11/1971 | Riddle et al. | 226/11 X |
| 3,712,558 | 1/1973 | Johnson et al. | 242/76 X |
| 3,741,453 | 6/1973 | Pierce et al. | 226/95 X |
| 3,782,616 | 1/1974 | Sorber, Jr. | 226/43 |
| 3,855,457 | 12/1974 | Amundson et al. | 101/69 X |
| 3,881,666 | 5/1975 | Greenhalgh | 242/72.1 X |
| 4,033,494 | 7/1977 | Middleton et al. | 226/83 |
| 4,085,881 | 4/1978 | Roberson | 226/95 |
| 4,544,110 | 10/1985 | Nagel et al. | 242/195 X |
| 4,955,553 | 9/1990 | Noé et al. | 242/72.1 X |

FOREIGN PATENT DOCUMENTS

| | | | |
|---|---|---|---|
| 968555 | 9/1964 | United Kingdom | 226/95 |

*Primary Examiner*—Daniel P. Stodola
*Assistant Examiner*—John Rollins
*Attorney, Agent, or Firm*—Charles J. Brown

[57] ABSTRACT

A roll-to-roll counter for stamp strips formed in rolls which includes a head assembly with a vacuum/pressure drum drive, a perforation sensor and a cutting device for separating the strip at the sensed perforation, and further includes an automatic self-loader on a take-up reel, an automatic wind-up device and an automatic release after take-up.

10 Claims, 3 Drawing Sheets

ROLL-TO-ROLL STAMP COUNTER

BACKGROUND OF THE INVENTION

Postage stamps or any other rectangular paper or web units separable from one another along perforation lines are available in bulk amounts either in rolls with the stamps joined end-to-end by lateral perforations or in sheets with the stamps joined both end-to-end and side-to-side. This invention concerns the former and in particular it relates to apparatus for accurately and rapidly counting the number of stamps in a roll or in rapidly dividing ("batching") a supply roll into sub-rolls of stamps of an accurate count.

It is not an exaggeration to say that no apparatus heretofore available has the capability of performing these functions automatically at high speed and with virtually absolute accuracy. Postage stamps are commonly sold from dispensing machines in which rolls previously taken from larger rolls are mounted. It is obviously important to know the number of stamps, i.e. the monetary value, in the roll first placed in the dispensing machine and in what remains after some use, so that the cash receipts and the remaining stamps in the machine can be reconciled with the number of stamps originally put in. In this age of high technology it is indeed surprising that there has been no apparatus or method available to postal authorities to do this counting of stamps in rolls. The conventional practice is to do it manually, by having the line of stamps drawn out by hand in short lengths against a measuring rule with a count kept of the number of times such application of lengths to the rule is made. This is so inefficient that heretofore the remaining rolls have been destroyed rather than manually counted and reconciliation of receipts to stamps has been foregone. Furthermore the inability to count large rolls quickly and accurately has compelled acceptance of approximations of bulk amounts.

The problems that have confounded those attempting to design roll-to-roll stamp counters, with or without batching means, are several. Perforation line spacing in stamp strips is far from precise and therefore counting apparatus must not miscount because some stamps are longer or shorter between perforations. Also, if optical counting means are to be relied upon such as light-emitting diodes, the counter must be able to ignore variations in translucency or opacity resulting from different stamp designs between the perforations. Even more importantly a counter must be able to contend with lateral perforation lines which in some cases are sometimes not complete or partially clogged with foreign material, over as much as half the length of the lateral perforation line. Another challenge is how to draw the line of stamps through a counter at high speed without physically damaging the paper of the stamp strip or the design printed thereon.

The present invention provides a device for counting stamps in rolls with speed and extremely high accuracy by bringing together a unique combination of vacuum/-pressure drive drum means, perforation sensor and cutting means, automatic self-loading means on the take-up reel, automatic wind-up means after cutting and automatic release after take-up. Variations of some of these means may be found in photocopy equipment, camera roll-up devices, wallpaper printing machines, self-returning reels and cable or expandable collets in machine tools. However they have never been combined as contemplated by the present invention to achieve accurate high speed enumeration and batching of large rolls of stamps where it never before has been possible.

SUMMARY OF THE INVENTION

Apparatus is provided by the invention for counting stamps joined end-to-end by lateral locus lines, typically perforation lines, in a stamp strip formed in a roll. A supply spindle is included upon which the roll is axially rotatable. A head assembly is included and among its parts is a driven foraminous translatable transport surface against a portion of which the strip is engagable. Pneumatic means in the head assembly is provided for exposing the engaged strip to a vacuum to hold it to the transport surface and draw it positively from the roll. Displacement means are included for continuously displacing the strip from the transport surface. The head assembly also includes slot means for guiding the displaced strip in its travel path after being displaced from the transport surface. Sensor emission and detection means in the head assembly operate in the travel path for sensing and counting each passing sensor line. The sensor means may be light emitting and detecting means, with the light passing through each of the perforation lines in succession. The apparatus further includes take-up means which comprises a driven contractable collet, curved resilient finger means for lightly contacting the strip and directing it from said travel path about the collet to form a take-up roll of increasing size, and release means for contracting the collet and allowing removal of the take-up roll.

In its preferred form the transport surface is an outer cylindrical surface of a drum against an arcuate portion of which the strip is engagable, and the displacement means is pressure provided by the pneumatic means to displace the strip from the drum. The head assembly may include a stationary plug within the drum formed with a first relief cut in which vacuum is created and a second relief cut in which pressure is created and a housing about the drum in which entry and exit slots are formed for guiding the stamp strip. The drum may be a substantially cup-shaped member having a rim formed with a multiplicity of holes. The light emitting and detecting means may comprise a plurality of light emitters paired with a corresponding plurality of light detectors operating across the travel path to sense a substantial length of each lateral perforation line.

When functioning both to count and to batch stamps, the apparatus includes in the head assembly cutting means operable across the travel path at the same locus where the sensor emission and detection means operates in that path for cutting the stamp strip exactly along one of the sensor locus lines after an exact predetermined number of stamps has passed that locus. Slipping clutch means may be included in the take-up means to permit the collet to be driven faster than required to match the travel of the strip from the head assembly, and wind-up spring means may be included to continue driving the collet after cutting of the stamp strip until the last of the strip is fully rolled into the take-up roll.

DESCRIPTION OF PREFERRED EMBODIMENT

The word "stamp" or "stamps" as used herein and in the following claims means not only postage stamps but any units of paper, plastic or other web material in strips divided into separable end-to-end units by successive lateral lines nominally, though perhaps not precisely, spaced uniformly apart. The stamp counter of the invention provides means for counting and/or batching an exact number of such stamp units and then reforming the strips into rolls.

Much of the apparatus of the invention is enclosed in a generally six-sided case of rectangular cross section which includes an upper deck 10 which is horizontal when the apparatus is in operation. The enclosure may be hinged along one of its longer upper edges at about the level of the deck 10 to a lid and equipped with appropriate handles and latches to be manually portable as readily as a medium-sized piece of luggage.

Figure 1:
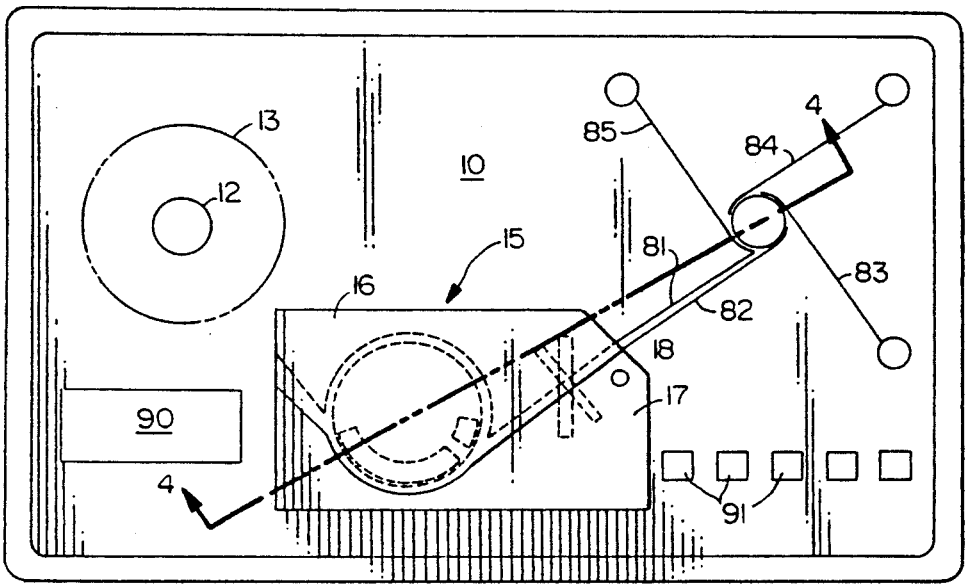
FIG. 1 is a plan view of the stamp counter of the invention.
Figure 3:
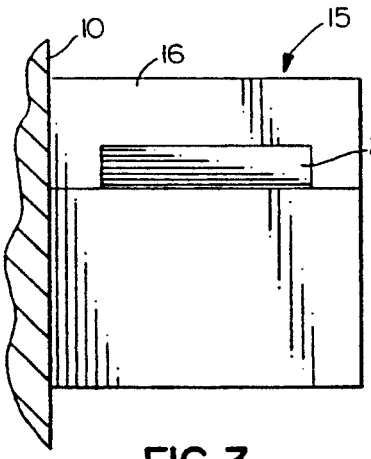
FIG. 3 is a side elevation of the left side of the head assembly shown in FIG. 2.

Projecting upwardly through an appropriate aperture in the deck 10 is a stationary supply spindle 12 of a diameter to fit somewhat snugly but slidably within the inside diameter of a roll of stamps 13, illustrated by the dot-dash lines in FIG. 1. There may be thousands of stamp units in a typical roll 13. The object is to produce accurately counted sub-rolls from the roll 13 or accurately count all of the stamps in the roll 13.

A head assembly 15 also extends upwardly from the deck 10. It includes a body 16 affixed to the deck 10 and a jaw bar 17 pivoted to the deck 10 about a pin 18 to swing horizontally open in the direction of the arrow in FIG. 2 for access to the parts within the head assembly 15. In its closed position shown, the jaw bar 17 together with the body 16 defines an entry slot 20, an enclosed cylindrical drum cavity 21 and an exit slot 22. The slots 20 and 22 are of thin rectangular cross section slightly wider than the width of the stamp strip. The entry slot extends generally tangentially from the drum cavity 21 along a line generally tangential with the supply spindle 12. The exit slot 22 also extends tangentially from the drum cavity 21 but in an opposite direction so that the entry and exit slots together converge to an arc of the drum cavity 21 periphery comprising less than half of its circumference.

Figure 2:
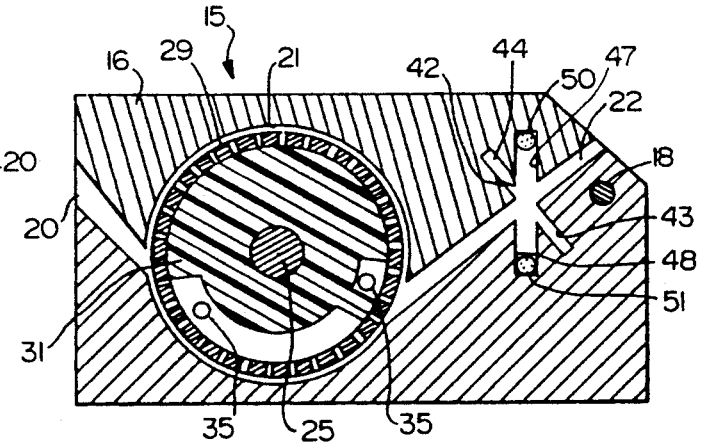
FIG. 2 is an enlarged horizontal section through the head assembly of the stamp counter.
Figure 4:
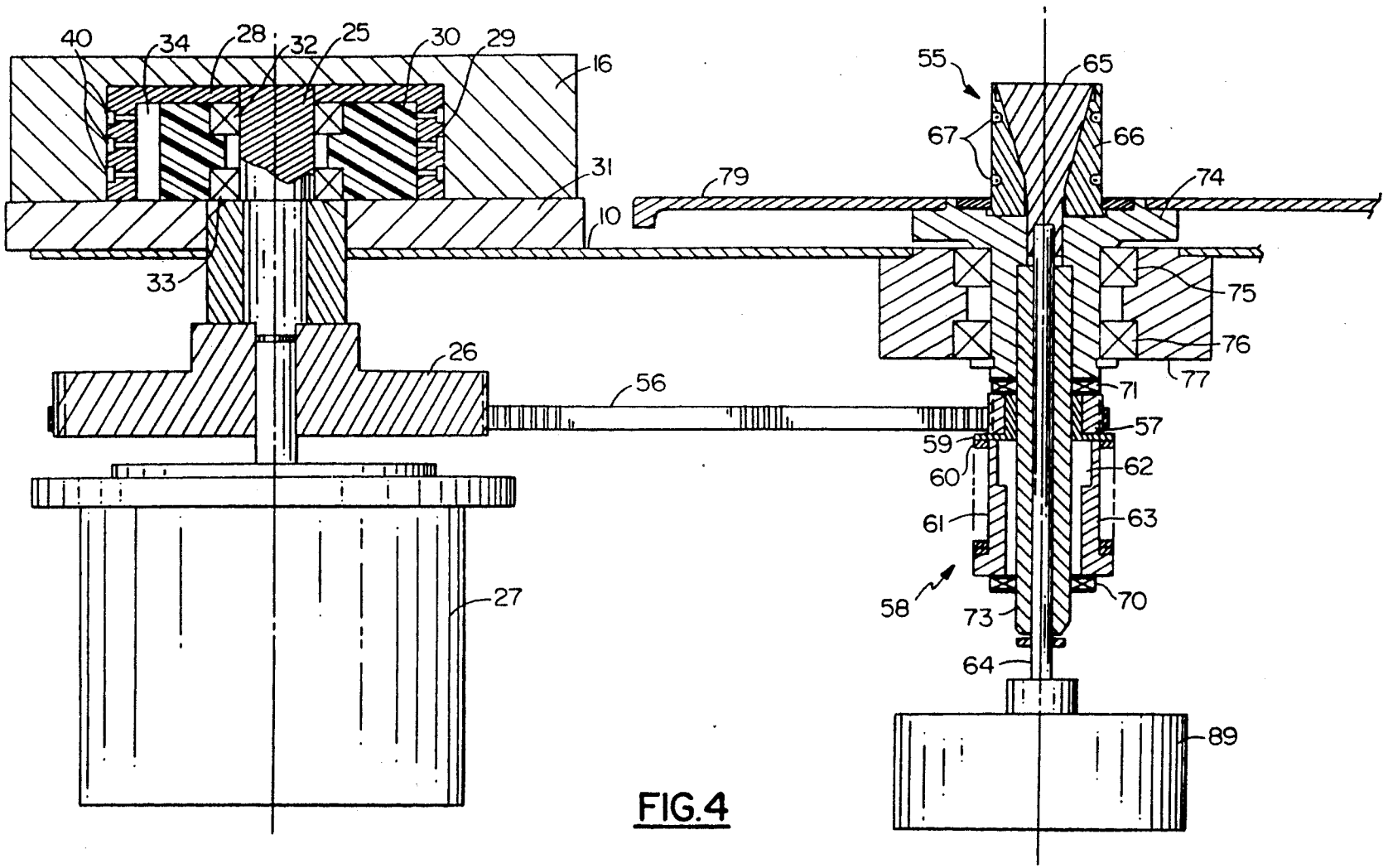
FIG. 4 is an enlarged section taken along the line 4—4 of FIG. 1 showing the drive drum and take-up collet and their drive means.
Figure 5:
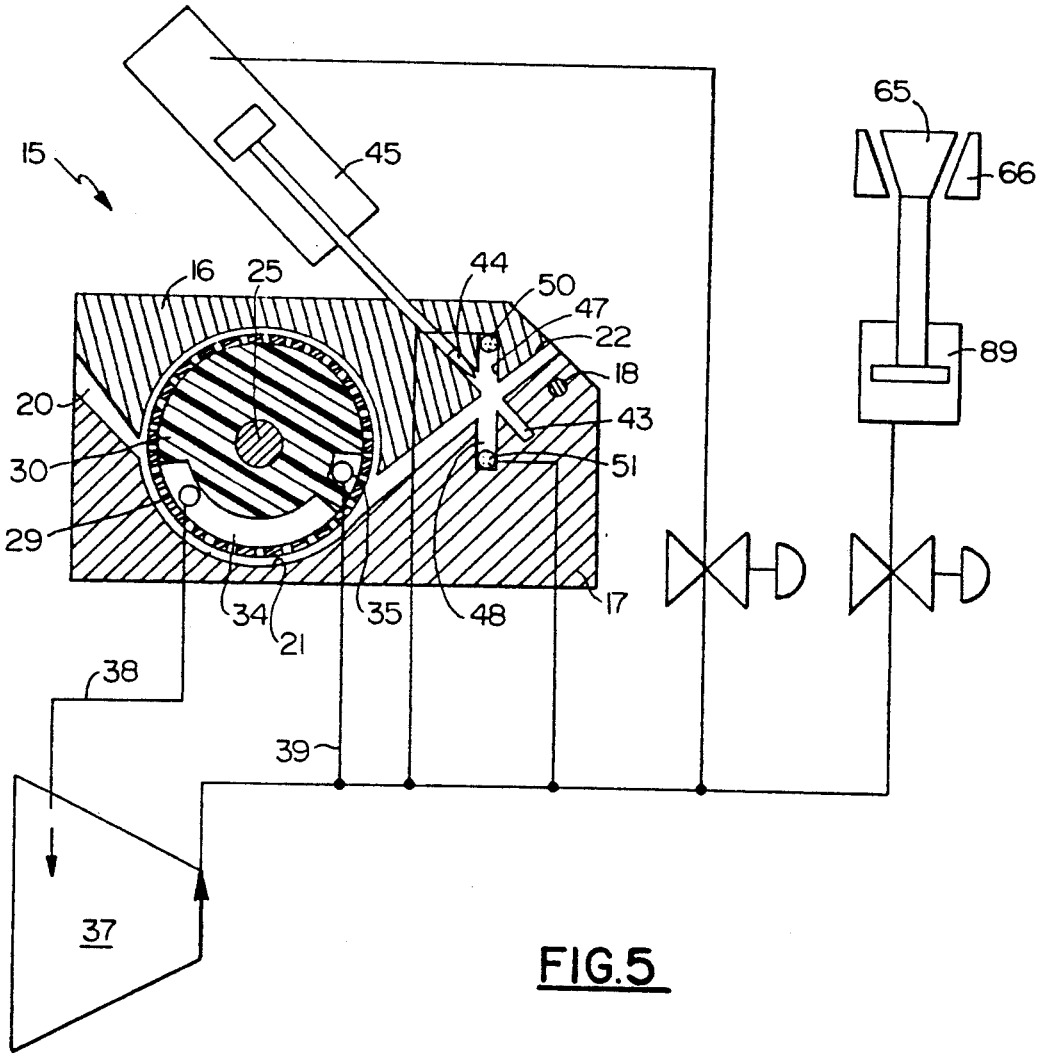
FIG. 5 is a diagram illustrating the pneumatic system for the stamp counter of the invention.

Extending concentrically into the drum cavity 21 through an appropriate opening in the deck 10 is a drive shaft 25 shown in FIGS. 2, 4 and 5. A drive pulley 26 is affixed about the drive shaft 25 within the enclosure below the deck 10 and connected in line beneath it is an electric drive motor 27.

Affixed concentrically to the upper end of the drive shaft 25 is an inverted cup-shaped drive drum 28 which has a downwardly extending circular rim 29 about its periphery. Within the drive drum 28 and encircling the shaft 25 is a fixed generally annular plug 30 secured to a spacer 31 which is fixed to the deck 10. The drive shaft 25 turns inside the fixed plug 30 on a pair of bearings 32 and 33. Formed in the cylindrical outer surface of the plug 30 is an arcuate vacuum relief cut 34 and a much smaller pressure relief cut 35 both shown in FIG. 2. As illustrated schematically in FIG. 5, an air compressor 37, also located within the enclosure beneath the deck 10, is connected at its suction side by line 38 to the vacuum relief cut 34 and at its discharge side by line 39 to the pressure relief cut 35. The entry slot 20 and the exit slot 22 in the head assembly 15 join the drum cavity 21 with the vacuum relief cut 34 and the pressure relief cut 35 intersected generally between them.

The rim 29 on the drive drum 28 is foraminous, which is to say it is formed with a multiplicity of radial holes 40 arranged in a plurality of circumferential rows as shown in FIG. 4. The inside surface of the rim 29 of the drive drum 28 is spaced very close to but not in contact with the outer periphery of the annular plug 30. With the drive motor 27 and the compressor 37 operating the drive drum 28 spins at a high rotational velocity about the plug 30 and air is pulled through the holes 40 as they pass over the vacuum relief cut 35. This air flow is drawn principally through the entry slot 21. Also with the drive motor 37 and compressor 37 operating, air is expelled under pressure from the pressure relief cut 35 as the holes 40 in the rim 29 pass over it, and that air is discharged outwardly through the exit slot 22.

In the body 16 of the head assembly 15 is a rectangular slot 42, shown on end in FIG. 2, intersecting the full width of the exit slot 22 at a right angle. Aligned with the slot 42 is a similar slot 43 in the jaw bar 17 so that together they comprise a cutting slot 42–43. Slidable within the cutting slot 42–43, and nominally in the slot 42 thereof, is a knife blade 44 having a length slightly greater than the width of the stamp strip. The edge of the blade 44 can be thrust quickly through the exit slot 22 by a pneumatic cylinder and piston 45 schematically shown in FIG. 5.

Angled approximately 20° from the cutting slot 42–43 is a rectangular slot 47, shown on end in FIG. 2, in the body 16 aligned with a similar slot 48 in the jaw bar 17, so that together they comprise a sensor slot 47–48. The sensor slot 47–48 intersects the full width of the exit slot 22 at the same locus as the cutting slot 42–43. Each of the slots 42–43 and 47–48 is slightly wider than the width of the stamp strips. At the inner end of the slot 47 in the body 16 is a row of three side-by-side infrared emitters 50, one of which is visible in FIGS. 2 and 5. In the inner end of the slot 48 in the jaw bar 17 is a similar row of three detectors 51 of infrared light paired with the emitters 50. When light pulses from the emitters 50 and reaches the detectors 51 a pulse of electrical voltage is generated which is sent to an electronic counting unit, not shown.

The exit slot 22 extends along a line generally tangential to a take-up collet assembly 55 which is driven from the main motor 27 by a toothed belt 56. A driven pulley 57 is attached freely around the axis of the collet assembly 55 and applies torque thereto by means of a slipping clutch assembly 58. Included in the clutch assembly 58 are a pair of friction discs 59–60, one on the pulley 57 and one on the collet assembly 55, pressed together by a compression spring 61. Concentrically within the slip clutch assembly 58 is a wind-up spring 62 connecting an outer case 63 of the collet assembly 55 with an inner sleeve 73. The inner sleeve 73 is driven by a belt 56 through the clutch assembly 58 and the spring 62. Inside the sleeve 73 is a plunger 64 with a back-tapered portion 65 which engages inner tapers 66 of the collet assembly 55. Elastomeric rings 67 encircle the tapers 66 and urge them radially inwardly. A thrust bearing 70 at the lower end of the case 63 holds it and the pulley 59 in opposition to an upper thrust bearing 71.

The plunger 64 is axially movable within the sleeve 73 fixed to a circular collet base 74 which is rotatable on bearings 75 and 76 in a bearing housing 77 secured to the underside of the deck 10. A take-up reel base 79 may be provided on the collet base 74 but it is not necessary.

Turning to FIG. 1, an entry guide strip 81 mounted on the deck 10 is paired with a similarly mounted first guide finger 82 to define a guideway therebetween which is in line with the exit slot 22. Three more guide fingers 83–84 and 85 are also provided each affixed to the deck 10 by a post at one end thereof so that the four guide fingers 82–85 are generally spaced 90° apart with their free ends converging and curved around the take-up collet assembly 55. The entry guide strip 81 is shorter than the fingers and straight, not quite touching the take-up collet assembly 55. The four fingers 82–85 and the entry guide strip 81 are formed of resilient and stiff material such as spring-tempered steel to allow them to bend elastically away as a roll forms on the take-up collet assembly 55.

The operation of the roll-to-roll stamp counter of the invention will now be described in its two modes. The batch mode is that wherein a roll of stamps is unwound and cut and re-rolled into batches of exactly enumerated stamps. The counting mode is that wherein the original roll of stamps is simply unrolled and rolled up again with the exact number of stamps therein accurately counted.

In the batch mode a roll 13 of stamps is placed upon the supply spindle 12 with the drive motor 27 and the compressor 37 in operation. The lead end of the stamp strip from the roll 13 is fitted manually into the entry slot 20 of the head assembly 15. The spinning drive drum 29 attracts the first stamp or stamps to its surface and retains them there by the vacuum created in the vacuum relief cut 34. The rotating drum 29 carries the stamp line forward, drawing in more from the roll 13, so that immediately following exposure to the vacuum relief cut 34 the line of stamps is exposed to the force of air from the pressure relief cut 35 which blows the leading edge of each stamp off to enter the exit slot 22. The vacuum method of holding the stamp strip to the drum causes no damage to the paper or the print of the stamps. Typically the printed side of the stamp strip is away from the surface of the drive drum 29 and remains untouched, an advantage over conventional pinch-roller/capstan drives commonly used in tape recorders and sprocket drives commonly used in movie film transport. Also, there is a gradual increase in traction as a stamp line is initially fed in against the spinning drum 29 which provides a safe tactile feed-back to guide the operator in the insertion process. It also allows for insertion without stopping the drive.

As the stamp strip proceeds through the exit slot 22 the infrared light from the row of emitters 50 directed at the row of detectors 51 alternately pulses from a read condition when the perforations intersect the light to a no-read condition when the remainder of the opaque stamps intersect the light. Each light pulse in the read condition creates an electrical voltage pulse at the detectors 51 which is fed to an electronic counting unit, not shown. Variations in the space between perforations, which are common, will not affect the count. Blockage of some or even a majority of the perforations along one lateral perforation line will not affect the count either, because of the use of three emitters 50 and three detectors 51, at least one pair of which can be relied upon to create the count signal if the other pairs are blocked.

In the electronic system of the counter of the invention, all of which is contained in the housing beneath the deck 10, electrical signals can be generated based upon a precise pre-selected count which first slows the drive motor 27 and then briefly stops it and then operates the pneumatic cylinder 45 to cause the blade 44 to cut behind the last desired stamp, which assures that the cut will occur at the perforation and nowhere else. Some of the discharged air from the compressor 37 may be directed by appropriate ports through the sensor and emitter slots 47–48 to provide a continuous flow of clean air out of those slots and away from the emitters 50 and detectors 51, thus assuring that no dust remains in the slots to obscure the light path. This air exits through the exit slot 22, thus aiding the movement of the stamp strip downstream by floating the strip on an air cushion from each side.

The use of infrared light detection means provides strong and rapid detection of perforations compared to visible light or pneumatic systems. The detection light of the apparatus of the invention is transmitted through the perforations in the stamp strip rather than reflected and this permits the use of the coincident cutter slot, eliminating the possibility of erroneous cut placement at detection times.

After passing out of the end of the exit slot 22 the stamp line passes between the entry guide 81 and the first guide finger 82. The curved-end guide fingers 82-85 bend elastically away as the roll of stamps forms on the take-up collet assembly 55. This has the advantage of a very large ratio achievable between initial and final roll diameters, as much as 8:1. Also there is no marring of the stamps because of the low contact pressure and smooth surface ends of the guide fingers. The take-up system is of the utmost simplicity with no moving parts other than the flexure of the fingers and the rotation of the collet itself, a marked advantage over the multiple interdigitating rolls of a wallpaper winder which require a gripping surface and complex drives with retractable rolls. Such conventional winders also cannot provide a fixed center diameter as does the present invention.

The collet assembly 55 is driven faster than required to match the flow of stamps from the head assembly 15. The wind-up spring 62 absorbs this speed differential initially until it is turned to its limit, thereafter forcing the clutch assembly 58 to continuously slip to maintain the winding tension for the new roll. As the new roll accumulates toward the desired size the drive motor 27 is programmed to slow the feed and take-up and to bring it to a stop when the trailing perforation on the last stamp is exactly within the cutting slot 42–43, as noted previously. The knife 44 then cuts the new roll from the supply and the back tension thus released allows the wind-up spring 62 to relax, causing several revolutions of the collet assembly 55 and thereby bringing the cut tail of the new stamp roll into place for removal. An air cylinder 89 is then automatically actuated to move the plunger 64 to allow the collet segment 66 to move inwardly and permit the finished roll to be removed.

This automatic wind-up and automatic release collet assembly 55 eliminates manual steps otherwise required in operation of conventional machines.

Occasionally a supply roll may have only one or two stamps remaining after a last batch is cut and the small remainder will remain in the head assembly 15. This will cause a miscount if not detected before a new supply roll is loaded. To clear the remaining stamps a strip of at least five stamps should be directed through the head assembly 15 to push out the small remainder. That strip and the ejected remainder may be discarded.

The counting mode operation is identical to the batch mode operation described above except that there are no interruptions for cutting. A digital read-out display 90 on the deck 10 may indicate the progressive count of the stamps determined by the emitters and sensors. A suitable array of push buttons 91 may also be provided on the deck 10 for power, switching back and forth between modes, etc.

If the stamps to be counted and/or batched are of typical quality, apparatus in accordance with the invention can count in excess of 2500 stamps per minute and batch up to 1100 stamps per minute, from input rolls of up to seven inches in diameter with an accuracy of only one erroneous count in well over 20,000 stamps. The apparatus may be portable and carried in its own hand held case. Its weight may be as little as forty pounds.

The scope of this invention is to be determined by the following claims rather than the foregoing description of preferred embodiment.

We claim:

1. Apparatus for counting stamps joined end-to-end by lateral perforation lines in a stamp strip formed in a roll comprising a) a supply spindle upon which the roll is axially rotatable, b) a head assembly comprising i) a driven foraminous translatable transport surface against a portion of which the strip is engageable, ii) pneumatic means exposing the engaged strip to a vacuum to hold it to the transport surface and draw it positively from the roll, iii) displacement means for continuously displacing the strip from the transport surface, iv) slot means for guiding the displaced strip in its travel path after being displaced from the transport surface, and v) a plurality of light emitters paired with a corresponding plurality of light detectors operating across said travel path to sense a substantial length of and count each lateral perforation line;

c) take-up means comprising i) a driven contractable collet, ii) resilient means for lightly contacting the strip and automatically directing it from said travel path about the collet to form a take-up roll of increasing size, and iii) automatic release means for contracting the collet when counting is complete and allowing removal of the take-up roll.

2. Apparatus according to claim 1 wherein the transport surface is an outer cylindrical surface of a drum against an arcuate portion of which the strip is engageable and said displacement means is pressure provided by said pneumatic means to displace the strip from the drum.

3. Apparatus according to claim 2 wherein the head assembly includes a stationary plug within the drum formed with a first relief cut in which said vacuum is created and a second relief cut in which said pressure is created, and a housing about the drum in which entry and exit slots are formed for guiding the stamp strip.

4. Apparatus according to claim 2 wherein the drum is a substantially cup-shaped member having a rim formed with a multiplicity of holes.

5. Apparatus for counting and batching stamps joined end-to-end by lateral perforation lines in a stamp strip formed in a roll comprising a) a supply spindle upon which the roll is axially rotatable, b) a head assembly comprising i) a foraminous drive drum against an arcuate portion of which the strip is engagable, ii) pneumatic means exposing the engaged strip to a vacuum to hold it to the drum and draw it positively from the roll and to pressure to displace the strip from the drum, iii) slot means for guiding the displaced strip in its travel path after being displaced from the drum, iv) light emitting and detecting means operating across the travel path for sensing and counting each perforation line, and v) cutting means operable across the travel path at the same locus where the light emitting and detecting means operates across said path for cutting the stamp strip along one of the perforation lines after the last of a predetermined number of stamps has passed said locus;

c) take-up means comprising i) a driven contractable collet, ii) resilient means for lightly contacting the strip and automatically directing it from said travel path about the collet to form a take-up roll of increasing size, iii) slipping clutch means permitting the collet to be driven faster than required to match the travel of the strip from the head assembly, iv) wind-up spring means to continue driving the collet after cutting of the stamp strip until the last of the predetermined number of stamps is fully rolled into said take-up roll, and v) automatic release means for contracting the collet and allowing removal of the take-up roll with its predetermined number of stamps.

6. Apparatus according to claim 5 wherein the head assembly includes a stationary plug within the drum formed with a first relief cut in which said vacuum is created and a second relief cut in which said pressure is created, and a housing about the drum in which entry and exit slots are formed for guiding the stamp strip.

7. Apparatus according to claim 5 wherein the drum is a substantially cup-shaped member having a rim formed with a multiplicity of holes.

8. Apparatus according to claim 5 wherein the light emitting and detecting means comprises a plurality of light emitters paired with a corresponding plurality of light detectors operating across said travel path to sense a substantial length of each lateral perforation line.

9. In apparatus for counting and batching stamps joined end-to-end by lateral perforation lines in a stamp strip formed in a roll, a head assembly comprising a) a driven substantially cup-shaped foraminous drum having a rim against an arcuate portion of which the strip is engagable and being formed with a multiplicity of holes, b) pneumatic means exposing the engaged strip to a vacuum to hold it to the drum and draw it positively from the roll and to pressure to displace the strip from the drum, c) a stationary plug within the drum formed with a first relief cut in which said vacuum is created and a second relief cut in which said pressure is created, d) a housing about the drum in which entry and exit slots are formed for guiding the stamp strip, e) a plurality of light emitters paired with a corresponding plurality of light detectors operating across said travel path in the exit slot to sense a substantial length of and count each lateral perforation lines, and f) cutting means operable across the travel path in the exit slot at the same locus where the light emitters and detectors operate across said path for cutting the stamp strip along one of the perforation lines after the last of a predetermined number of stamps has passed said locus.

10. In apparatus for counting and batching stamps joined end-to-end by lateral perforation lines in a roll which includes a supply spindle for the roll and a head assembly for drawing the strip from the roll and counting the perforation lines and cutting the strip at one perforation line after the last of a predetermined number of stamps has passed, take-up means comprising a) a driven contractable collet about which the strip is wound to form a take-up roll of increasing size, b) slipping clutch means permitting the collet to be driven faster than required to match the travel of the strip from the head assembly, c) wind-up spring means to continue driving the collet after cutting of the stamp strip until the last of the predetermined number of stamps is fully rolled into said take-up roll, and d) release means for contracting the collet and allowing removal of the take-up roll with its predetermined number of stamps.

* * * * *